US007412912B2

(12) United States Patent
Smith

(10) Patent No.: US 7,412,912 B2
(45) Date of Patent: Aug. 19, 2008

(54) VEHICLE PEDAL DRYING APPARATUS

(76) Inventor: Nathaniel Smith, 2711 W. Johnday Ave., Kennewick, WA (US) 99336

( * ) Notice: Subject to any disclaimer, the term of this patent is extended or adjusted under 35 U.S.C. 154(b) by 474 days.

(21) Appl. No.: 11/250,861

(22) Filed: Oct. 15, 2005

(65) Prior Publication Data

US 2007/0137418 A1 Jun. 21, 2007

(51) Int. Cl.
*G05G 1/14* (2006.01)

(52) U.S. Cl. ..... 74/560

(58) Field of Classification Search ..... 74/512–514, 74/560

See application file for complete search history.

(56) References Cited

FOREIGN PATENT DOCUMENTS

JP 2003204918 A * 7/2003

JP 2006248306 A * 9/2006

* cited by examiner

*Primary Examiner*—Chong H Kim
(74) *Attorney, Agent, or Firm*—Raymond M. Galasso; Galasso & Associates, LP

(57) ABSTRACT

A drying system configured to dry the pedals of a vehicle as well as the footwear of the driver of the vehicle. The dry system includes an air trap for catching and diverting air from the ventilation system of the vehicle. A multi tube adapter is connected between the air trap and multiple tubes. The tubes are configured direct the air flow from the multi tube adapter to each of the pedals. The tubes are connected to the rear portion of the pedals and direct air flow into a chamber of each of the pedals. Each of the pedals includes multiple holes on the surface and bottom. The holes permit the air flow to exit the chamber of the pedal, thereby drying the pedals and further permit the air flow to blow onto the footwear of the driver, drying footwear of the driver. The holes on the bottom portion of each of the pedals permit air and liquid to exit the chamber of each of the pedals, thereby preventing liquid buildup within each of the chambers of the pedals.

20 Claims, 2 Drawing Sheets

VEHICLE PEDAL DRYING APPARATUS

FIELD OF THE INVENTION

The present invention relates to devices for improving vehicle safety, and more specifically but not by way of limitation, to vehicle pedal drying system operable to dry the pedals of a vehicle, and thus reduce the number of accidents caused by liquid or ice on the pedals of a vehicle, such as the accelerator, clutch and brake pedals.

BACKGROUND

Driving in vehicles can be a very demanding task. The driver must take extreme care to help prevent accidents. The driver must not only maker sure that they are physically able to drive, but they must also make sure that the vehicle is mechanically safe. Using the foot pedals in a vehicle, such as the accelerator and the brake pedals, are also vital in controlling a vehicle. The foot pedals are the only things that give a driver direct control of the speed of the vehicle. Even if the vehicle is mechanically safe, other things can create problems for the driver. One problem is wet and/or slippery pedals caused by water, snow or ice. One slip of the drivers foot off of an impaired pedal, such as at a busy intersection, could be disastrous.

Accordingly there is a need for a pedal drying system that works with existing vehicles, that can safely, and quickly dry wet foot pedals.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
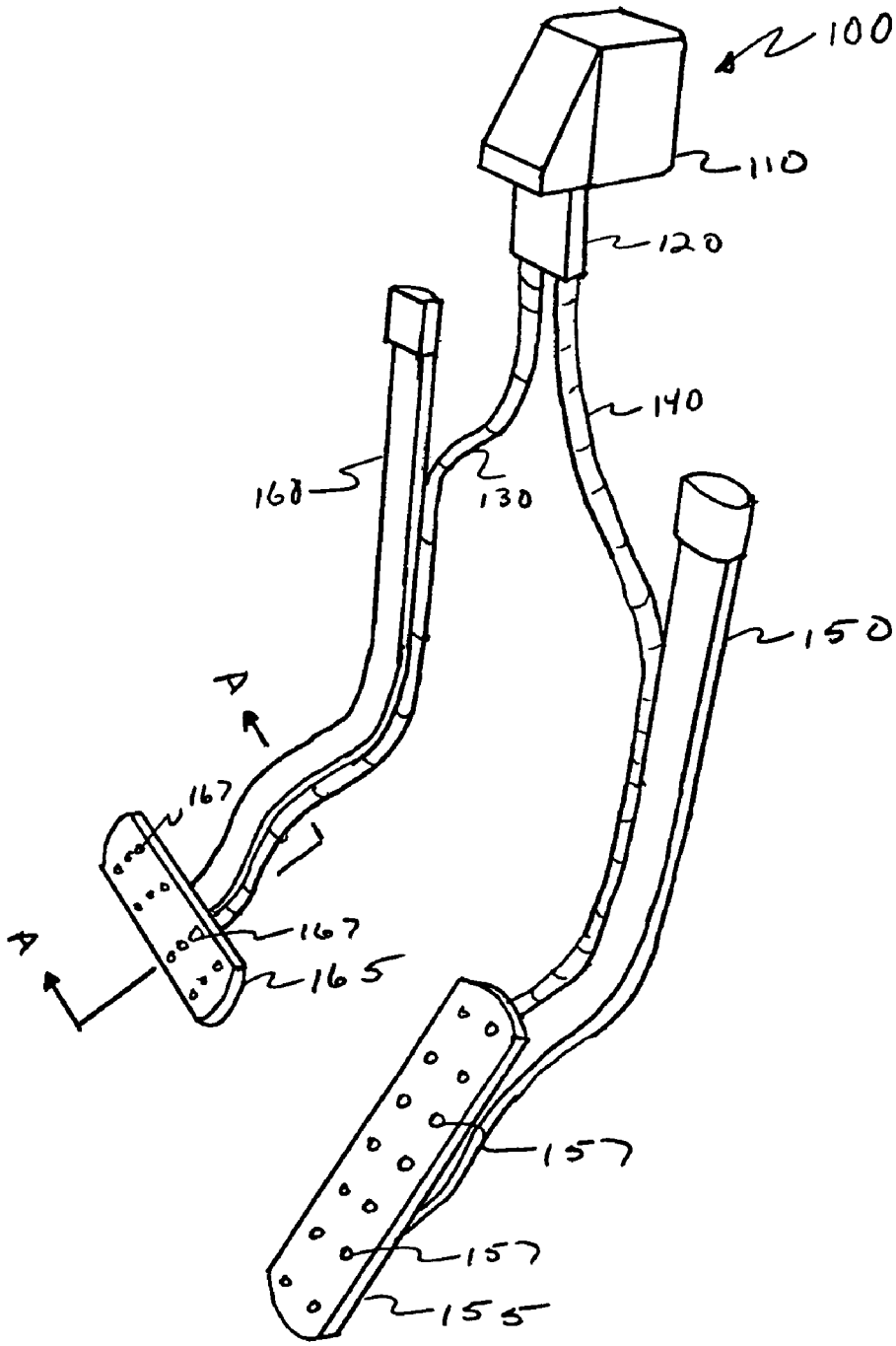
FIG. 1 illustrates a perspective view of an embodiment of the present invention.
Figure 2:
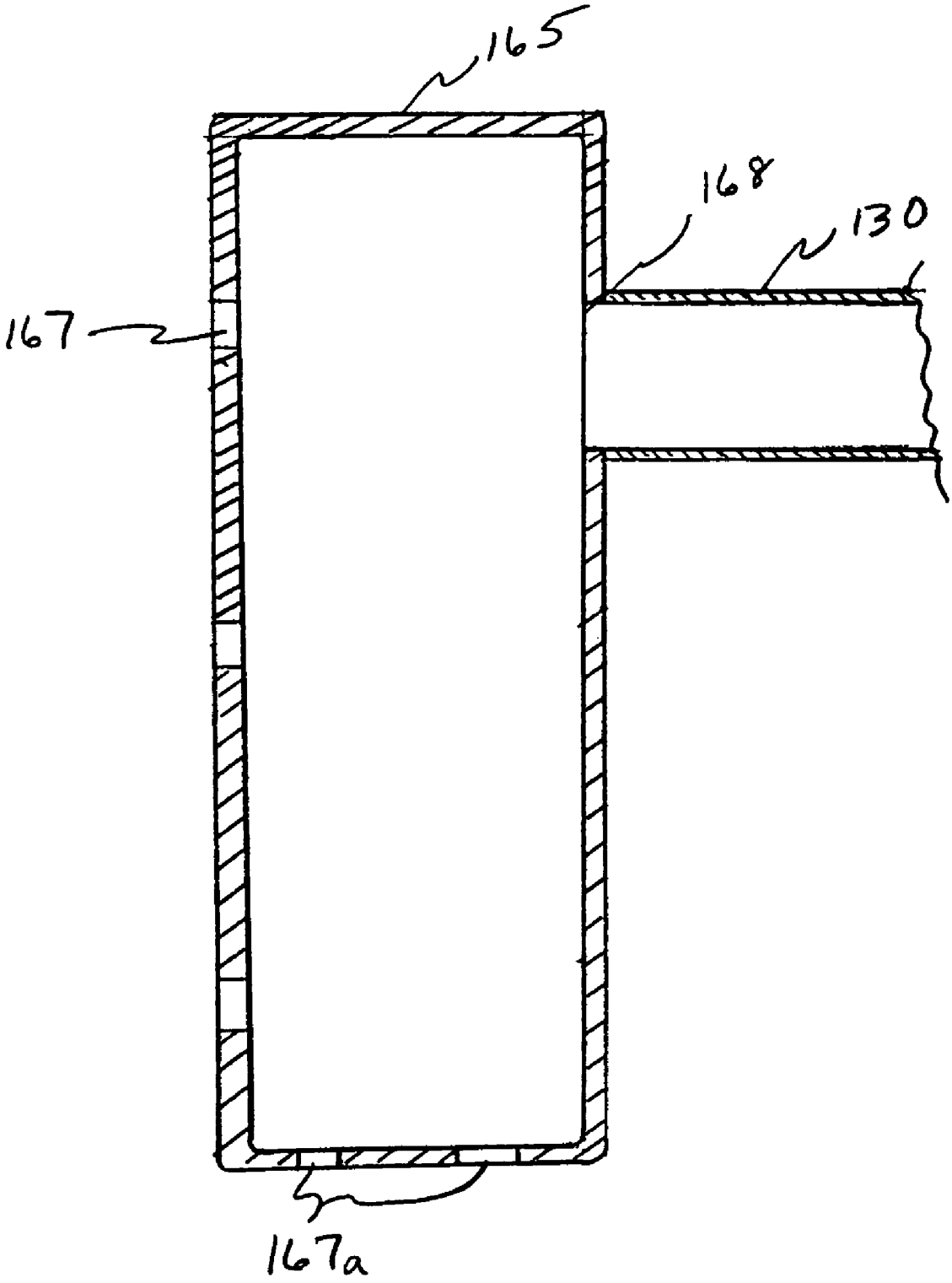
FIG. 2 illustrates a cross-sectional view taken along line A-A of the embodiment as shown in FIG. 1.

Referring now to the drawings submitted herewith, wherein various elements depicted are not necessarily drawn to scale, and in particular FIGS. 1 and 2 there is illustrated a preferred embodiment of a pedal drying system 100 in accordance with the principles of the present invention. Pedal drying system 100 includes an air trap 110, for receiving air from the HVAC system of the vehicle. A multi tube adapter 120 is connected to the air trap 120. Multi tube adapter 120 is configured to receive tubes 130 and 140, and is for directing air flow from air trap 110 into tubes 130 and 140.

Tube 140 traverses down along accelerator mechanism 150 and connects to accelerator pedal 155. Tube 130 traverses down along brake mechanism 160 and connects to brake pedal 165. Tubes 130 and 140 can be attached to brake mechanism 160 and accelerator mechanism 150, respectively, by various mechanical devices or chemical. Accelerator mechanism 150 is configured to be connected to a typical accelerator system of the vehicle and operates by the depression and release of the accelerator pedal 155. Brake mechanism 160 is configured to be connected to a typical brake system of the vehicle and operates by the depression and release of the brake pedal 165.

Accelerator pedal 155 is a hollow pedal and includes holes 157 extending from the exterior of accelerator pedal 155 to the interior of accelerator pedal 155. Similarly, brake pedal 165 is a hollow pedal and includes holes 167 extending from the exterior of brake pedal 165 to the interior of brake pedal 165.

Although pedal drying system 100 is illustrated in a two pedal system, it is contemplated to be within the scope of this invention, that pedal drying system 100 could also be configure to accommodate a system with any number of pedals. For example, some vehicles have an accelerator, brake, and a clutch pedal. Therefore, pedal drying system 100 could be configured with a multi tube adapter 120 to allow three tubes, one for each of the accelerator, brake and clutch pedals.

Referring now to FIG. 2, there is illustrated a cross-sectional view taken along line A-A shown in FIG. 1. As illustrated brake pedal 165 is generally hollow and includes an opening 167 on the rear and is configured to receive tube 130. As if further illustrated, holes 167 extend through brake pedal 165. Brake pedal 165 also includes openings or holes 167*a* positioned at the bottom portion of brake pedal 165. Holes 167*a* facilitate the removal of any liquid that enter brake pedal 165.

It is further contemplated to be within the scope of this invention, that a brake pedal 165 could include a small access door, or sliding door at the bottom to facilitate the removal of any debris from within brake pedal 165.

The thickness of the walls of brake pedal 165 can be varied pursuant to a particular use or specification, however, good results have been achieved utilizing a thickness of ¾ inches.

Accelerator pedal 155 is constructed in a similar manner to brake pedal 165, with the exception of the size and shape. As can be appreciated, the present invention can be configured to accommodate any shape pedal.

It is further contemplated to be within the scope of this invention that pedal drying system 100 could be configured to attached to existing pedals. An interchangeable back plate would be configured to mate with an existing pedal. The back plate would have an opening to receive a tube, such as tube 130. The back plate would be attached to the existing pedal from the rear. If necessary holes would be created in the existing pedal to permit air flow.

It is further contemplated to be within the scope of this invention, that various hollow configurations of a pedal could be utilized. For example, but not by way of limitation, the pedal could be configured with multiple hollow tubes that run behind the pedal rather than having a single hollow chamber.

Pedal drying system could be constructed of various materials, including, but not limited to, high density plastic, graphite, flex tubing, recycled plastics, rubber or synthetic rubber material to inhibit and prevent rust. Good results have been achieved constructing air trap 110 out of non rusting material, and can be modified in shape to conform to a select vehicles venting system.

Referring now to both FIGS. 1 and 2, a preferred operation of pedal drying system 100 will now be described. Air trap 110, which is connected to the ventilation system of the vehicle, catches air there from and directs the air flow to multi tube adapter 120. Air trap 110 can be configured to allow manual or automatic adjustment of the amount of air that it catches and directs into the multi tube adapter 120.

There the air is directed into tubes 130 and 140, whereby it is delivered to the corresponding pedal. The air is forced into the pedal and out through the holes. As can be appreciated, the air captured by air trap 110 and delivered to the pedals, could be heated, cooled, or just vented air. An additional advantage of this embodiment is that the air not only dries the pedals, but will also help dry the footwear of the operator. Additionally, with the air passing out of the holes of the pedals, and blowing on at least a portion of the operator, pedal drying system facilitates some added comfort to the operator.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A vehicle pedal drying system comprising:

an air trap configured to capture air from the ventilation system of the vehicle;

at least one tube connected between the air trap and a first pedal of the vehicle, said at least one tube directing air from said air trap through said at least one tube; and an interface proximate said first pedal of the vehicle, said at least one tube connected to said interface, said interface directing air from said at least one tube to said first pedal of the vehicle.

2. The vehicle pedal drying system as recited in claim 1, wherein said interface is connected to said first pedal of the vehicle forming a hollow chamber therein.

3. The vehicle pedal drying system as recited in claim 2, wherein said first pedal of the vehicle includes at least one hole journaled through a front surface of said first pedal, said at least one hole permits air flow from said chamber through said at least one hole.

4. The vehicle pedal drying system as recited in claim 3, and further including a multi tube adapter connected intermediate said air trap and said at least one tube.

5. The vehicle pedal drying system as recited in claim 4, and further including at least a second tube connected between said multi tube adapter and a second pedal, said at least a second tube directing air from said multi tube adapter there through.

6. The vehicle pedal drying system as recited in claim 5, and further including a second interface proximate said second pedal, said at least a second tube connected to said second interface, said second interface directing air from said at least a second tube to said second pedal.

7. The vehicle pedal drying system as recited in claim 6, wherein said second interface is connected to said second pedal of the vehicle forming a hollow chamber therein.

8. The vehicle pedal drying system as recited in claim 7, wherein said second pedal includes at least one hole journaled through a front surface of said second pedal, said at least one hole of said second pedal permits air flow from said chamber of said second pedal through said at least one hole of said second pedal.

9. The vehicle pedal drying system as recited in claim 8, wherein said first pedal includes an opening, said opening positioned at the base of said first pedal, said opening for at least permitting air and liquid from exiting said hollow chamber of said first pedal.

10. A vehicle drying system for drying the pedals of the vehicle and the footwear of the user, comprising:

an air trap configured to capture air from the ventilation system of the vehicle;

a first pedal;

a first tube connected between the air trap and said first pedal, said first tube directing air from said air trap through said first tube; and said pedal including a front portion and a rear portion, said first tube connected to said rear portion of said pedal.

11. The vehicle pedal drying system as recited in claim 10, wherein said first pedal is configured with chamber therein and further wherein said first tube is connected to said first pedal such that air is directed into said chamber of said first pedal.

12. The vehicle pedal drying system as recited in claim 11, wherein said first pedal includes a plurality of holes journaled through said front portion, said plurality of holes permitting air flow out of said chamber.

13. The vehicle pedal drying system as recited in claim 12, and further including a multi tube adapter connected intermediate said air trap and said first tube.

14. The vehicle pedal drying system as recited in claim 13, and further including a second pedal and a second tube, said second pedal including a front portion and a rear portion, said second tube connected between said multi tube adapter and said rear portion of said second pedal, said second tube directing air from said multi tube adapter to said second pedal.

15. The vehicle pedal drying system as recited in claim 14, wherein said second pedal is configured with chamber therein, and further wherein said second tube is connected to said second pedal such that air is directed into said chamber of said second pedal.

16. The vehicle pedal drying system as recited in claim 15, wherein said second pedal includes a plurality of holes journaled through said front portion of said second pedal, said plurality of holes permitting air flow out of said chamber of said second pedal.

17. The vehicle pedal drying system as recited in claim 16, wherein said first pedal includes a bottom portion, said first pedal including an opening on said bottom portion permitting at least air and liquid from exiting said chamber of said first pedal.

18. The vehicle pedal drying system as recited in claim 16, wherein said second pedal includes a bottom portion, said second pedal including an opening on said bottom portion permitting at least air and liquid from exiting said chamber of said second pedal.

19. A vehicle drying system for drying the pedals of the vehicle and the footwear of a user, comprising:

an air trap configured to capture air from the ventilation system of the vehicle;

a first pedal having a front portion and a rear portion;

a second pedal having a front portion and a rear portion;

a multi tube adapter connected to said air trap;

a first tube connected between said multi tube adapter and said rear portion of said first pedal, said first tube directing air from said air trap through said first tube; and a second tube connected between said multi tube adapter and said rear portion of said second pedal, said second tube directing air from said air trap through said first tube.

20. The vehicle pedal drying system as recited in claim 19, wherein:

said first pedal is configured with a chamber therein and further wherein said first tube is connected to said first pedal such that air is directed into said chamber of said first pedal;

said first pedal includes a plurality of holes journaled through said front portion of said first pedal, said plurality of holes permitting air flow out of said chamber of said first pedal;

said first pedal includes a bottom portion, said first pedal including an opening on said bottom portion permitting at least air and liquid from exiting said chamber of said first pedal;

said second pedal is configured with chamber therein, and further wherein said second tube is connected to said second pedal such that air is directed into said chamber of said second pedal;

said second pedal includes a plurality of holes journaled through said front portion of said second pedal, said plurality of holes permitting air flow out of said chamber of said second pedal; and said second pedal includes a bottom portion, said second pedal including an opening on said bottom portion permitting at least air and liquid from exiting said chamber of said second pedal.

* * * * *